US006774563B2

(12) United States Patent
Kling

(10) Patent No.: US 6,774,563 B2
(45) Date of Patent: Aug. 10, 2004

(54) SUPPORT FOR A LAMP CAPSULE AND END-OF-LIFE DEVICE, LAMP INCLUDING SUCH CAPSULE, AND METHOD OF COUPLING LAMP CAPSULE AND END-OF-LIFE DEVICE TO SUCH SUPPORT

(75) Inventor: Michael R. Kling, Lexington, KY (US)

(73) Assignee: Osram Sylvania Inc., Danvers, MA (US)

( * ) Notice: Subject to any disclaimer, the term of this patent is extended or adjusted under 35 U.S.C. 154(b) by 87 days.

(21) Appl. No.: 09/963,987

(22) Filed: Sep. 26, 2001

(65) Prior Publication Data

US 2003/0057834 A1 Mar. 27, 2003

(51) Int. Cl.[7] ..... H01J 7/44; H01J 17/34

(52) U.S. Cl. ..... 313/623; 313/631; 313/25; 313/574; 315/56; 315/57; 315/58; 315/73

(58) Field of Search ..... 313/623, 631, 313/25, 574, 577, 491, 563, 526; 315/56–58, 73

(56) References Cited

U.S. PATENT DOCUMENTS

| | | | | | |
|---|---|---|---|---|---|
| 4,195,251 | A | * | 3/1980 | Bamberg | 315/73 |
| 4,208,614 | A | * | 6/1980 | Strauss et al. | 315/73 |
| 4,376,259 | A | * | 3/1983 | Rothwell et al. | 315/74 |
| 4,599,543 | A | * | 7/1986 | Strok | 315/73 |
| 5,339,006 | A | * | 8/1994 | Schellen | 315/58 |
| 5,585,693 | A | * | 12/1996 | Shaffer | 313/489 |
| 6,380,676 | B1 | * | 4/2002 | Bankuti et al. | 313/574 |

* cited by examiner

*Primary Examiner*—Nimeshkumar D. Patel
*Assistant Examiner*—Sikha Roy
(74) *Attorney, Agent, or Firm*—William E. Meyer

(57) ABSTRACT

A support device is provided for use with an electric lamp having a sealed outer envelope that encloses an environment, and a lamp capsule and end-of-life device positioned within such environment. The support device serves to support the lamp capsule and the end-of-life device within the outer envelope. The end-of-life device is electrically connected in series with the lamp circuit through the support device.

13 Claims, 3 Drawing Sheets

SUPPORT FOR A LAMP CAPSULE AND END-OF-LIFE DEVICE, LAMP INCLUDING SUCH CAPSULE, AND METHOD OF COUPLING LAMP CAPSULE AND END-OF-LIFE DEVICE TO SUCH SUPPORT

TECHNICAL FIELD

The present invention relates to an electric lamp which includes an end-of-life device that will safely extinguish the source of light when an outer lamp envelope is broken, without adversely substantially affecting lamp efficacy or providing an undesirable second light source during normal lamp operation. The present invention is particularly of interest regarding a tungsten halogen lamp.

BACKGROUND ART

A problem with some electrical lamps is that they present a fire hazard and may cause burns should the outer lamp envelope break. Although there is more than one type of lamp with respect to which this problem applies,the problem is particularly applicable to tungsten halogen lamps. Due to higher efficacy and coil temperatures, tungsten halogen lamps are attractive as replacements for ordinary incandescent filament lamps for general service lighting. However, tungsten halogen lamps typically operate at high bulb wall temperature and high internal pressure. For these reasons, tungsten halogen lamps are usually operated in fixtures with shielding to protect against accidental contact. The use of special fixtures increases the cost of using a tungsten halogen lamp and limits its usefulness to those applications where use of such a fixture is practical. In an alternative embodiment, it is known to seal the typical halogen capsule in an outer envelope having a thick wall that performs the shielding function. However, the use of thick walls increases the cost of the lamp and reduces the transmission of light. In addition, the thick walls of the lamp adds to its weight which can be a problem with some fixtures.

The use of a tungsten halogen lamp having a thin outer envelope is well known. However, such lamps present a potential safety hazard should the outer envelope break and the inner halogen capsule continue to operate. In particular, the wall temperature of the tungsten halogen inner capsule is high enough to cause bums and to ignite various materials such as paper and fabric. The safety problem is compounded due to the fact that such lamps are intended as replacement lamps for general service incandescent lamps and therefore are likely to be used in a wide variety of lighting fixtures, some of which could easily be tipped over or damaged in such a way as to break the outer glass envelope exposing the still burning inner halogen capsule.

The use of other types of lamps involve problems similar to those of tungsten halogen lamps. For example, high pressure discharge lamps include an inner arc tube contained within an outer envelope. One of the functions of the outer envelope is to permit passage of visible light, and block ultraviolet radiation, emitted by the inner arc tube during use of the lamp. Should the outer envelope be broken, such ultraviolet radiation will be emitted out of the lamp into the environment proximate the lamp.

A number of ways have been disclosed to interrupt electrical current to an inner lamp in the event of damage to an outer lamp envelope. One example known for use with a high intensity discharge lamp involves positioning an oxidizable fuse within the outer envelope of the lamp and in series with the lamp circuit. Such fuse oxidizes and interrupts the lamp circuit in the event the outer envelope breaks and exposes the fuse to air, thereby extinguishing the lamp. One of the concerns in manufacturing such lamps is providing a satisfactory manner in which to support the lamp capsule and fuse element within the outer envelope. It is known to fabricate such lamps by electrically and mechanically connecting the fuse directly to electrical conductors within the outer envelope by welding and the like. This may involve a complicated fabrication procedure, and in some instances it may be difficult to accurately control the length of the fuse. In addition, such lamps may include fairly complicated supports for the lamp capsule contained within the outer envelope. Such supports typically include straps which surround the capsule at opposite ends thereof and are attached to one or more support rods extending from an inlead protruding from the lamp stem. An example of such a high intensity discharge lamp which includes an oxidizable link within the outer envelope is described in U.S. Pat. No. 4,361,782. In this patent. the inner lamp capsule is supported within an outer lamp envelope by strap clips welded to a rod which is welded to an inlead extending from the lamp stem the rod extending to a looped clip which engages an anchoring dimple of the outer envelope. The oxidizable link provides part of the lamp circuit by being connected directly to an inlead and a main electrode.

In another known high intensity discharge lamp, described in U.S. Pat. No. 4,305,020, a current-interrupting device is electrically and mechanically connected between the inner capsule lead wire and the capsule supporting frame. Such an embodiment requires a similarly complicated fabrication procedure, adding to the cost of the lamp.

DISCLOSURE OF THE INVENTION

It is an object of the present invention to provide an improved support for a lamp capsule and an end-of-life device positioned within an outer envelope.

It is another object of the present invention to obviate the disadvantages of the prior art by providing an improved support for a lamp capsule and an end-of-life device positioned within an outer envelope.

A further object of the present invention is to provide an economical, efficient and high quality support for a lamp capsule and end-of-life device positioned within an outer envelope.

Another object of the present invention is to provide an electric lamp which includes the support of the present invention.

Yet a further object of the present invention is to provide a tungsten halogen lamp which includes the support of the present invention.

A further object of the present invention is to provide an improved method of coupling a lamp capsule and an end-of-life device to a lamp stem.

Another object of the present invention is to provide a less costly manner of supporting a lamp capsule and an end-of-life device in place within an outer lamp envelope.

Yet a further object of the present invention is to provide support for a lamp capsule and end-of-life device, within an outer lamp envelope, that simplifies manufacturing, reduces component count and ensures accurate control of fuse length.

Another object of the present invention is to provide a support for a lamp capsule to which an end-of-life device can be readily attached.

This invention achieves these and other objects by providing support, for use with an electric lamp having a sealed outer envelope enclosing an environment, a lamp capsule within the environment, a first lead wire and a second lead wire extending through the lamp capsule, a first electrical conductor a second electrical conductor extending through the outer envelope and being electrically connected to the first lead wire and the second lead wire, respectively. An end-of-life device is provided within the environment electrically connected in series with the first lead wire and the first electrical conductor. The support comprises a first portion mechanically connectable to the lamp capsule, a second portion electrically connectable to the first lead wire and to the end-of-life device, and a third portion electrically connectable to the first electrical conductor and to the end-of-life device. The support joins the first portion and the second portion, a section of the third portion being removable to separate, and form a gap between, the second portion and the third portion. A lamp including the support of the present invention, and a method of coupling a lamp capsule and end-of-use device to a lamp stem, are also provided.

BRIEF DESCRIPTION OF THE DRAWINGS

This invention may be clearly understood by reference to the attached drawings in which like reference numerals designate like parts and in which.

MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
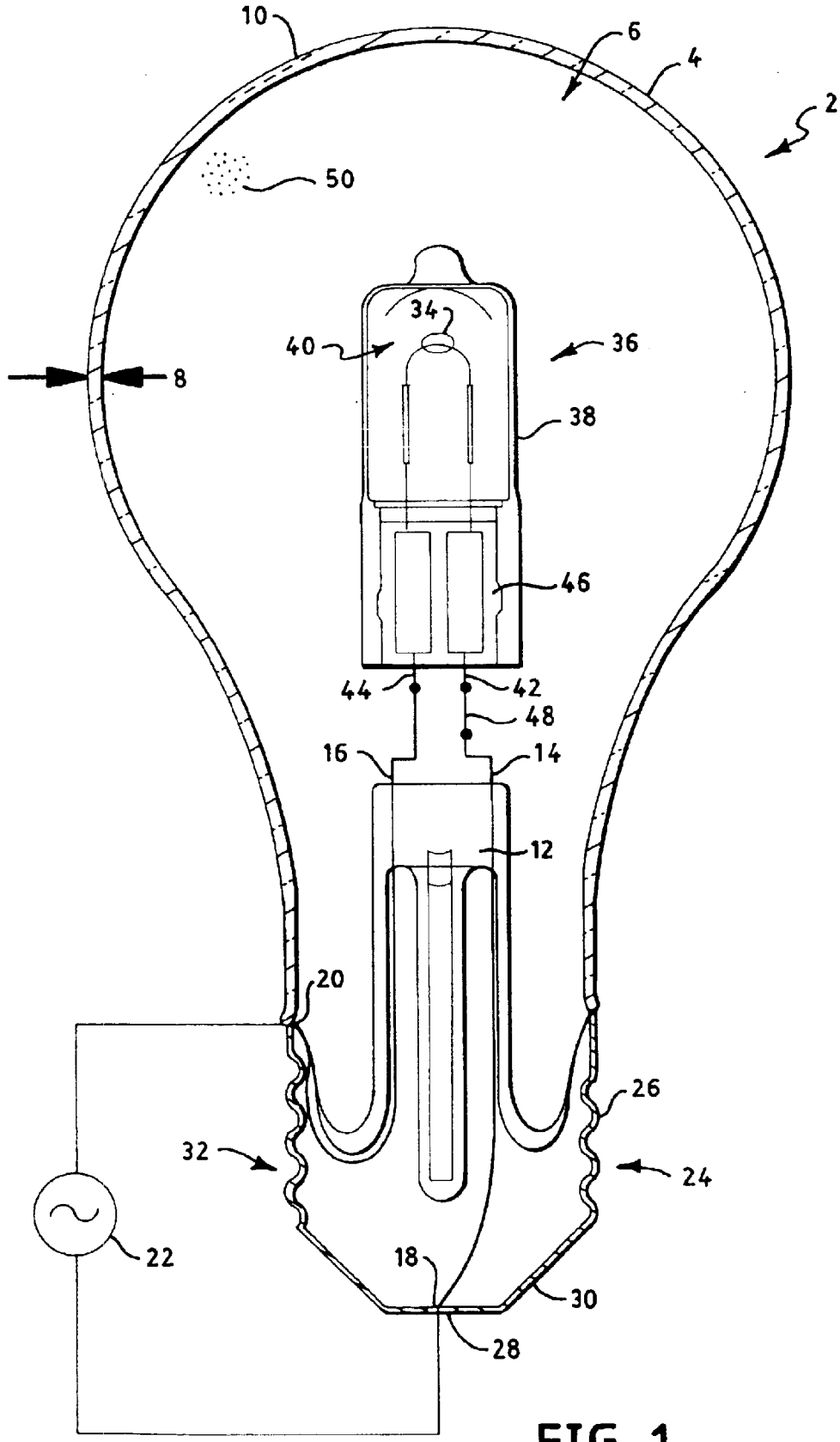
FIG. 1 is a diagrammatic illustration of an electric lamp with which a support of the present invention is useful.

FIG. 1 is a diagrammatic illustration of an incandescent tungsten halogen lamp to which the support of the present invention may be attached. Without limitation, the support of the present invention is applicable to other types of lamps such as high intensity discharge lamps. As a practical matter, the support of the present invention is useful in any lamp having an outer envelope and inner lamp capsule, and wherein an end-of-life device is provided within the outer envelope to prevent a safety hazard if the outer lamp envelope is broken but the inner lamp capsule remains energized. In the embodiment illustrated in FIG. 1, an electric lamp 2 is illustrated which comprises a sealed outer envelope 4 which encloses an air tight first environment 6. The envelope 4 is a vitreous material which is transparent to light. Envelope 4 may be fabricated in a conventional manner. The thickness 8 of the wall 10 which forms the envelope 4 is thin relative to that of a conventional tungsten halogen lamp. For example, the thickness of the outer envelope of a conventional tungsten halogen lamp is about 3 to 6 mm. In contrast, the thickness 8 may be about equal to that of the envelope of a conventional Edison-type lamp; that is, about 0.5 to 0.75 mm. The envelope 4 is sealed in a conventional manner at stem 12. First and second electrical conductors 14 and 16 are sealed into and pass through the envelope 4 at the stem 12 in a conventional manner. The ends 18 and 20 of the conductors 14 and 16 are electrically connectable external of the envelope 4 to a source 22 of electrical power. To this end, in the embodiment illustrated in FIG. 1, a conventional screw-type lamp base 24 is provided. Lamp base 24, which includes a metal base shell 26 and contact 28 separated by an insulator 30, is mechanically connected to the envelope 4 in a conventional manner. The lamp base 24 is electrically connected to conductors 14 and 16. To this end, end 20 of conductor 16 is welded to a side tap at the inner surface of the shell 26, and end 18 of conductor 14 is welded to contact 28 which forms a center tap, in a conventional manner. The metal base shell 26 is threaded at 32 for insertion into a mating internally threaded lamp socket (not shown).

The electric lamp illustrated in FIG. 1 includes an electric light source contained within the sealed outer envelope. For example, in the embodiment illustrated in FIG. 1, a light source 34 is contained within an electric lamp capsule 36. Lamp capsule 36 includes a sealed second envelope 38 contained within the first environment 6 enclosed by envelope 4. The envelope 38 encloses an air tight second environment 40. The envelope 38 is a vitreous material which is transparent to light. The electric lamp capsule 36 includes a first lead wire 42 and a second lead wire 44 sealed into and passing through the stem 46 of the capsule 36 in a conventional manner. The lamp capsule 36 may be in the form of a conventional tungsten halogen capsule contained within the first environment 6. Lead wires 42 and 44 are electrically coupled to electrical conductors 14 and 16, respectively, as described in more detail hereinafter, to provide for a lamp circuit. An end-of-life device is contained within the first environment enclosed by the outer envelope of the present invention. The end-of-life device is electrically connected in series with the lamp circuit. For example, in the embodiment illustrated in FIG. 1, an end-of-life device in the form of an oxidizable fuse 48 is contained within the environment 6 enclosed by the outer envelope 4. Fuse 48 is electrically in series with lead wires 42 and 44 of the lamp capsule 36. To this end, the fuse 48 is electrically connected between electrical conductor 14 and the lead wire 42, and the electrical conductor 16 is electrically connected to the lead wire 44.

The end-of-life device illustrated in FIG. 1 is of the type that will rapidly ignite during operation of the lamp in the presence of air to open the lamp circuit. The end-of-life device is positioned external of the lamp capsule and within the hermetically sealed thin wall outer envelope. In the embodiment illustrated in FIG. 1, the fuse 48 is of the type that will ignite in the presence of air to open the circuit that the fuse completes between the electrical conductor 14 and the lead wire 42.

The end-of-life device illustrated in FIG. 1, such as fuse 48, may be chosen from various types. For example, a straight or coiled foil or wire filament may be used. One preferred simple and cost effective end-of-life device is a coiled wire fuse. Any of a number of materials may be used. For example, metal or metal alloys that react with air at an elevated temperature, as described hereinafter, may be selected. Tungsten, tantalum, zirconium, halfnuim and aluminum are examples of metals which can be used. A preferred end-of-life device may be in the form of a coiled tungsten wire represented in FIG. 1 as the fuse 48. The coiled tungsten wire provides a pyrophoric fuse. Whatever form of end-of-life device is used, it must be capable of rapid ignition during lamp operation in the presence of air to thereby open the lamp circuit. In particular, if the outer envelope is damaged sufficiently to permit air to enter the air tight environment 6, the combination of radiation, convective and conductive heat flowing from the light source, in addition to any resistive self-heating of the end-of-life device generated by the lamp current during operation of the lamp will raise the temperature of the end-of-life device to a level at which exposure of the end-of-life device to the air will cause rapid oxidation of the end-of-life device, thereby opening the lamp circuit and extinguishing the light source and the heat generated thereby. In the embodiment illustrated in FIG. 1, coiled tungsten wire fuse 48 provides one means for rapidly opening the lamp circuit during operation of the light source in the presence of air.

The electric lamp illustrated in FIG. 1 may include a filling contained within the environment enclosed by the outer envelope. The filling may be inert at least relative to the end-of-life device. In addition, the filling may have a relatively high thermal conductivity. For example, such thermal conductivity may be high enough to cool the end-of-life device during energization of the light source, within the sealed outer envelope, sufficiently to lower resistance and power loss in the end-of-life device, thereby increasing lamp efficacy and eliminating visual radiation of the end-of-life device. In such an embodiment, as a practical matter, the filling will conduct away from the end-of-life device the heat generated therein during normal use of the energized lamp capsule. An example of such a filling is helium gas, illustrated at 50 in FIG. 1 by way of example. It should be noted that any conventional filling may be used. In some instances, no filling may be provided.

Figure 2:
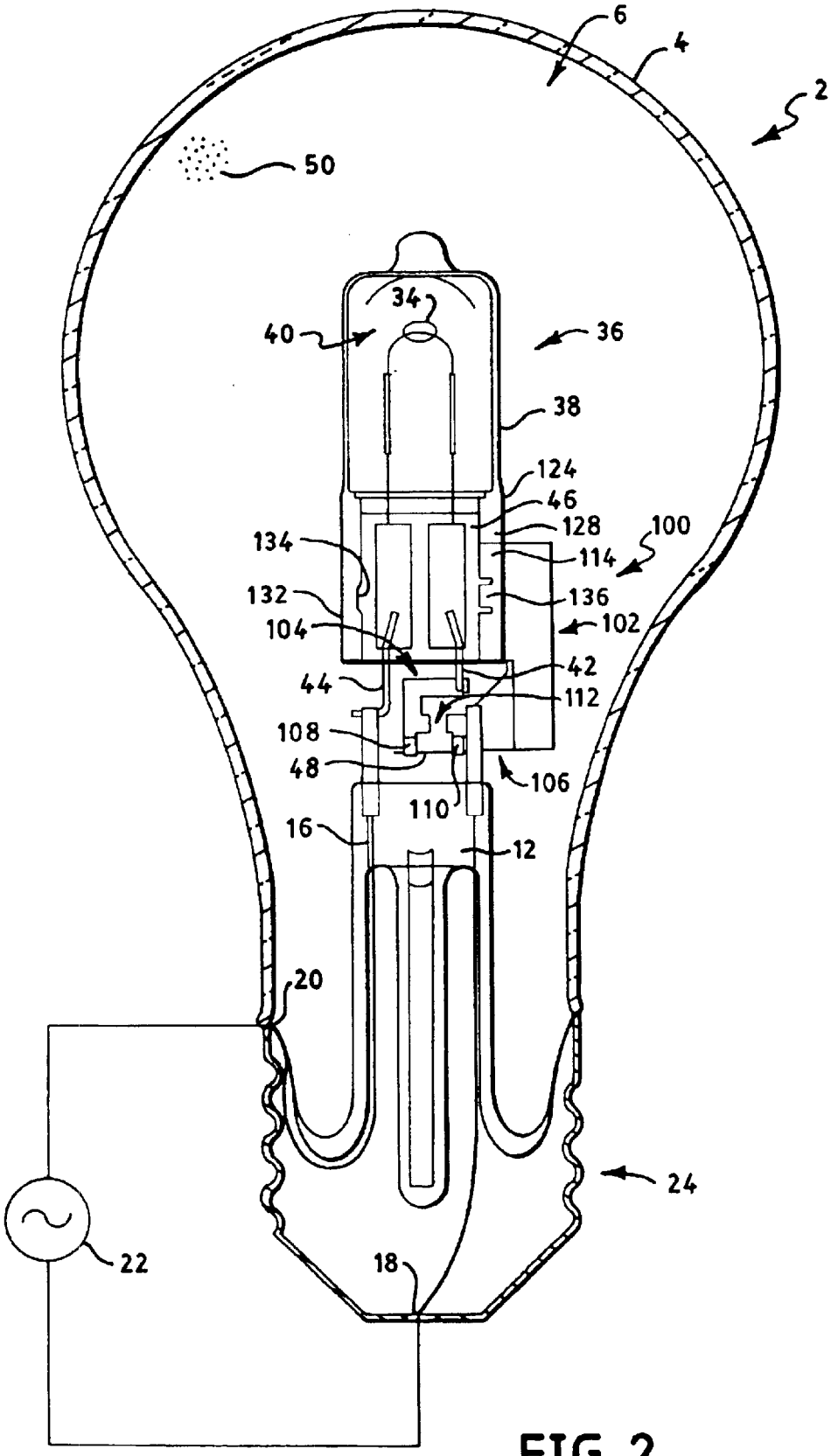
FIG. 2 illustrates an embodiment of an electric lamp of the present invention.
Figure 3:
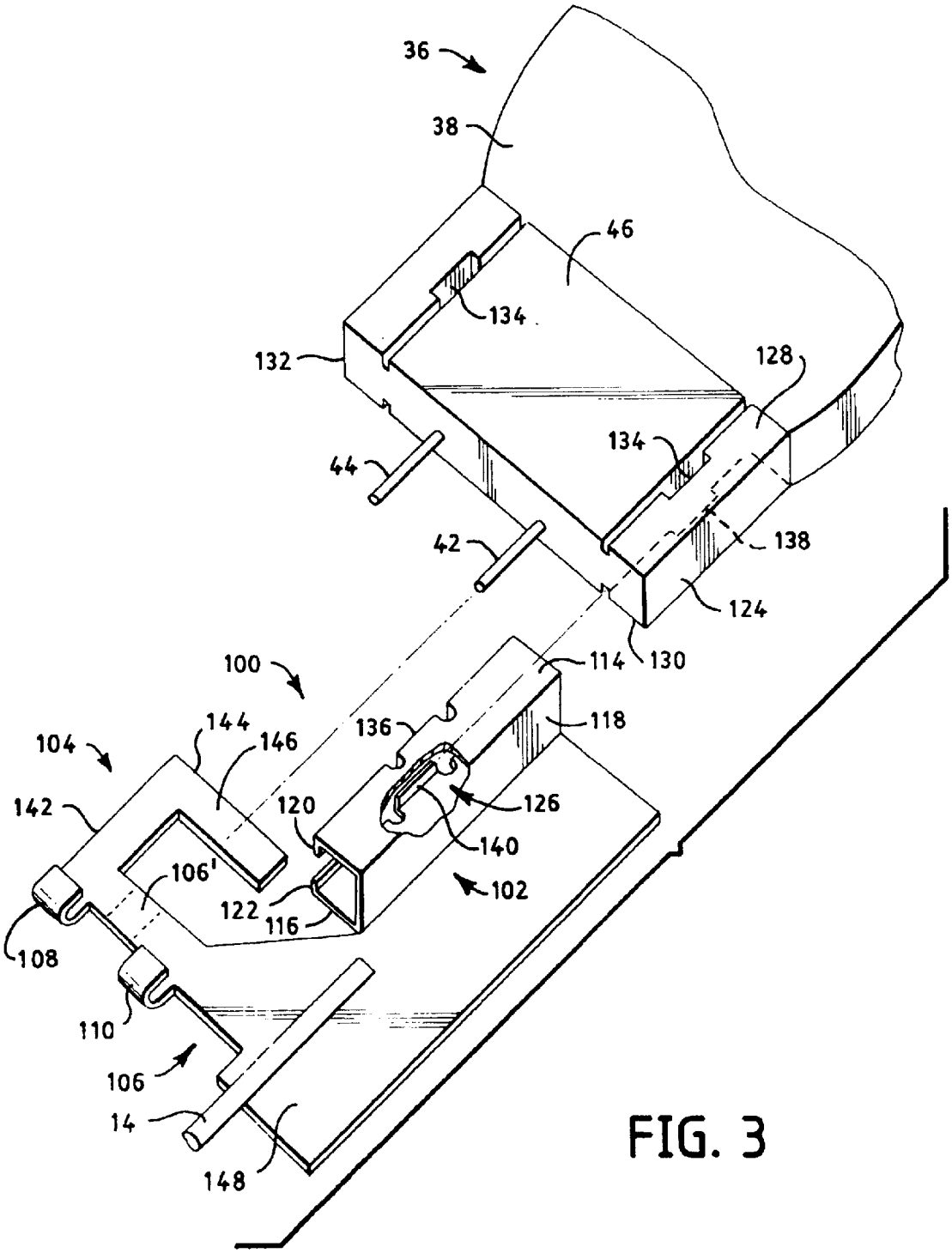
FIG. 3 illustrates the support of the present invention illustrated in the embodiment of FIG. 2.

The supporting structure of the present invention is provided to hold the end-of-life device in place. This simplifies manufacturing, reduces component count and ensures accurate control of fuse length, an important parameter for lamp performance. The supporting structure also serves to hold the lamp capsule in place. For example, FIGS. 2 and 3 illustrate one embodiment of a support 100 for an end-of life device 48 for use with the electric lamp 2 of FIG. 1. FIG. 2 illustrates the support 100 assembled with the lamp 2, and FIG. 3 illustrates the support prior to assembly. Support 100 includes a first portion 102 mechanically connectable to the lamp capsule 36. A conductive second portion 104 of the support 100 is electrically and mechanically connectable to the first lead wire 42, as for example, by welding. The support 100 also includes a conductive third portion 106 electrically and mechanically connected to the first electrical conductor 14. The end-of-life device 48 is electrically and mechanically connected between the second portion 104 and the third portion 106. In this manner, the end-of-life device is incorporated into the capsule support which improves manufacturing and reliability. To this end, the end-of-life device 48 can be connected to the second portion 104 and third portion 106 by welding, if desired. However, in the embodiment illustrated in FIG. 2, the end-of-life device 48 is connected to the second portion 104 and third portion 106 by clamps 108 and 110, respectively. Clamps 108 and 110 are in the form of folded over legs which extend from the body of respective portions 104 and 106. To attach the end-of-life device 48 to the support 100, the end-of-life device is positioned to extend between the portions 104 and 106 and lie within the clamps 108 and 110, the clamps then being closed to firmly hold the end-of-life device in place. A section 106' (FIG. 3) of the third portion 106 is removable to separate the second portion 104 and third portion 106 as illustrated at the gap 112 in FIG. 2, and described in more detail hereinafter. In one embodiment, the support 100 is formed from 0.38 mm thick stainless steel. However, the support 100 can be made of any material that can be formed into the proper shape and provide the required electrical conductivity.

In one embodiment of the present invention, the support for the end-of-life device may be attached to a lamp capsule having a stem, in which case the first portion of the support may be connectable to the stem. For example, in the embodiment illustrated in FIGS. 2 and 3, the lamp 2 includes the lamp capsule 36 which includes the stem 46, and the first portion 102 of the support 100 is mechanically connected to the stem. To this end, in the embodiment illustrated in FIGS. 2 and 3, the support 100 comprises opposing walls 114 and 116 each of which extends away from a base 118 to opposing wall flanges 120 and 122, respectively. Walls 114 and 116, including flanges 120 and 122, are structured and arranged to slidingly mate with the stem 46. For example, in the embodiment illustrated in FIGS. 2 and 3, the stem 46 is fabricated to include a rail 124. Rail 124 may be dimensioned so that it may be force fit into the opening 126 between the walls 114 and 116 of the support 100, the walls bearing against respective rail surfaces 128 and 130 to hold the lamp capsule 36 in place relative to the support 100. The lamp capsule 36 may be provided with an identical opposite second rail 132 SO that support 100 may be connected to either side of the stem 46 thereby eliminating the need to align a specific side of the stem with the support during the assembly process. In the embodiment illustrated in FIG. 3, the stem 46 has an I-beam configuration, the support 100 being structured and arranged to slide on either rail of the stem.

The stem 46 of the capsule 36 may be of the type having one or more locking segments that engage respective mating locking segments of the support walls to hold the capsule in place relative to the support. Such locking segments and mating locking segments may be in addition to or used in place of the force fit embodiment discussed above. For example, in the embodiment illustrated in FIGS. 2 and 3, the stem rail 124 includes a locking segment in the form of a recess 134 in surface 128, and the wall 114 includes a mating locking segment in the form of a detent 136. The recess 134 and detent 136 are structured and arranged such that when the rail 124 is inserted into the opening 126 between walls 114 and 116, the detent 136 will engage the recess 134 by snapping into the recess 134, when the lamp capsule 36 is properly axially positioned relative to the support 100, to hold the lamp capsule 36 in place relative to the support. In the embodiment illustrated in FIG. 3, the rail 124 includes a similar recess 138, in surface 130, that engages a similar detent 140 in wall 116, in the same manner. Rail 132 may include similar recesses 134 and 138.

In the embodiment illustrated in FIGS. 2 and 3, the second portion 104 of the support 100 comprises a first segment 142 extending from the third portion 106, and a second segment 144 extending from the first segment 142. The lead wire 42 is electrically and mechanically connected to the second segment 144, as for example, by welding the lead wire to surface 146.

The first segment 142 is parallel to the base 118 of the first portion 102 and the second segment 144 is perpendicular to the base 118. The electrical conductor 14 is electrically and mechanically connected to the third portion 106, as for example, by welding the electrical conductor to surface 148.

One method of fabricating the electric lamp of the present invention will now be described with reference to the electric lamp 2. A conventional lamp capsule 36 is formed having a first lead wire and a second lead wire. One example of such lamp capsule is a tungsten halogen capsule. A support is then attached to the capsule. For example, the support 100 may be attached to the stem 46 of the capsule 36 as described herein. Although not necessary, after the detents of the support engage the recesses of the stem, the support may be heated to the extent that melted stem glass further affixes the support to the stem. The lead wire 42 of capsule 36 is then welded to the surface 146 of the second portion 104 of the support 100. The next step is to remove the section 106' of the third portion 106 of the support 100 to form the gap 112 between the second portion 104 and third portion 106. This may be accomplished, for example, by mechanical cutting or burning out the section 106' using a laser or plasma torch. Any convenient gap width can be used. In the lamp illustrated in FIGS. 2 and 3, the gap is about 2–3 mm wide. Removal of the section 106' serves to separate the second portion 104 from the third portion 106. The end-of-life device 48 is then electrically and mechanically connected to the second portion 104 and third portion 106 of the connector 100, thereby providing structure that forces any current flow in the lamp circuit through device 48. To this end, in the embodiment illustrated in FIGS. 2 and 3, the coiled tungsten wire fuse 48 is fed into clamps 108 and 110, the fuse bridging the gap 112. The clamps 108,110 are closed to grip the fuse 48 and hold it in place. A glass stem assembly is prepared in a conventional manner, the stem including a conventional flared glass tube and exhaust tube, and the two electrical conductors 14 and 16. Electrical conductor 14 is then welded to surface 148 of the third portion 106 of the support member 100, and electrical conductor 16 is welded to the lead wire 44. The electrical conductor 14 may be more heavy duty than the electrical conductor 16 to provide sufficient support for the support 100 and lamp capsule 36 attached thereto. The lamp capsule 36, support 100, and stem assembly are then inserted into an outer envelope 4 which is then heated and melted down onto the stem 46 so that the stem fuses with and becomes part of the envelope 4, in a conventional manner. The lamp thus far assembled is affixed to a typical exhaust machine for pumping out, evacuating and filling the envelope in a conventional manner. Without limitation, in processing the lamp of the present invention, the envelope may be filled with a filling having a high thermal conductivity. For example, in the embodiment illustrated in FIGS. 2 and 3, a filling 50 may be helium fill gas supplied at a pressure of about 30 torr. When helium is the fill gas, pressures of about 10 torr to about 700 torr, or even greater, are possible, although the lower pressure the less tendency there is for an undesirable amount of helium to enter the quartz glass of the outer envelope. The envelope 4 is then sealed and the base 24 is attached to the envelope in a conventional manner. The electrical conductors 14 and 16 are welded or soldered to the base at ends 18 and 20 as described herein.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

I claim:

1. A support, for use with an electric lamp having a sealed outer envelope enclosing an environment, a lamp capsule within said environment, a first lead wire and a second lead wire extending through said lamp capsule, a first electrical conductor a second electrical conductor extending through said outer envelope and being electrically connected to said first lead wire and said second lead wire, respectively, and an end-of-life device within said environment and being electrically connected in series with said first lead wire and said first electrical conductor, said support comprising:

a first portion mechanically connectable to said lamp capsule;

a second portion electrically connectable to said first lead wire and to said end-of-life device; and a third portion electrically connectable to said first electrical conductor and to said end-of-life device, and joining said first portion and said second portion, a section of said third portion being removable to separate, and form a gap between, said second portion and said third portion.

2. A support, for use with an electric lamp having a sealed outer envelope enclosing an environment, a lamp capsule within said environment, a first lead wire and a second lead wire extending through said lamp capsule, a first electrical conductor a second electrical conductor extending through said outer envelope and being electrically connected to said first lead wire and said second lead wire, respectively, and an end-of-life device within said environment and being electrically connected in series with said first lead wire and said first electrical conductor, said support comprising:

a first portion mechanically connectable to said lamp capsule;

a second portion electrically connectable to said first lead wire and to said end-of-life device; and a third portion electrically connectable to said first electrical conductor and to said end-of-life device, and joining said first portion and said second portion, a section of said third portion being removable to separate, and form a gap between, said second portion and said third portion; and wherein said lamp capsule is of the type including a stem, and further wherein said first portion comprises opposing walls extending from a base, said opposing walls being structured and arranged to slidingly mate with said stem.

3. The support of claim 2 wherein said stem is of the type having one or more locking segment, and further wherein said opposing walls include one or more mating locking segment each which being engageable with a respective locking segment.

4. The support of claim 1 wherein said second portion comprises a first clamp and said third portion comprises a second clamp, and further wherein said end-of-life element is electrically and mechanically connectable to said second portion and said third portion by said first clamp and said second clamp, respectively.

5. The support of claim 1 wherein said second portion comprises a first segment extending from said third portion, and a second segment extending from said first segment, said first lead wire being electrically and mechanically connectable to said second segment and said end-of-life device being electrically and mechanically connectable to said first segment.

6. The support of claim 5 wherein at least a section of said first segment is parallel to said base and at least a section of said second segment is perpendicular to said base.

7. An electric lamp, comprising:

an outer envelope enclosing an environment;

a lamp capsule within said outer environment;

a first lead wire and a second lead wire extending through said lamp capsule;

a first electrical conductor and a second electrical conductor extending through said outer envelope and being electrically connected to said first lead wire and said second lead wire, respectively;

an end-of-life device within said environment and being electrically connected in series with said first lead wire and said second lead wire first electrical conductor; and a support, comprising:

a first portion mechanically connected to said lamp capsule;

a second portion electrically connected to said first lead wire and to said end-of-life device; and a third portion electrically connected to said first electrical conductor and to said end-of-life device; and wherein said lamp capsule includes a stem, and said first portion comprises opposing walls extending from a base and slidingly mated with said stem.

8. The electric lamp of claim 7 wherein said stem comprises one or more locking segment, and said opposing walls include one or more mating locking segment each of which engages a respective locking segment.

9. The electric lamp of claim 7 wherein said second portion comprises a first clamp and said third portion comprises a second clamp, said end-of-life device being electrically and mechanically connected to said second portion and said third portion by said first clamp said second clamp, respectively.

10. The electric lamp of claim 7 wherein said second portion comprises a first segment extending from said third portion, and a second segment extending from said first segment, said first lead wire being electrically and mechanically connected to said second segment and said end-of-life device being electrically and mechanically connected to said first segment.

11. The electric lamp of claim 10 wherein at least a section of said first segment is parallel to said base and at least a section of said second segment is perpendicular to said base.

12. The electric lamp of claim 7 wherein said lamp capsule is a tungsten halogen capsule.

13. Method of coupling a lamp capsule and an end-of-life device to a lamp stem having electrical conductors protruding from said stem, comprising the steps of:

attaching a first portion of a support, having a first portion, a second portion and a third portion, to said lamp capsule;

electrically and mechanically connecting a first lead wire of said lamp capsule to said second portion;

removing a section from said third portion forming a gap between said second portion and said third portion;

electrically and mechanically connecting said end-of-life device to said second portion and said third portion, said end-of-life device spanning said gap; and electrically and mechanically connecting a first electrical conductor protruding from said stem to said third portion and a second electrical conductor protruding from said stem to a second lead wire of said lamp capsule.

* * * * *